US005201853A

United States Patent [19]

Alwine

[11] Patent Number: 5,201,853

[45] Date of Patent: Apr. 13, 1993

[54] SWITCHING CONNECTOR ASSEMBLY

[75] Inventor: K. Troy Alwine, Warren, Pa.

[73] Assignee: GTE Products Corporation, Danvers, Mass.

[21] Appl. No.: 873,125

[22] Filed: Apr. 24, 1992

Related U.S. Application Data

[63] Continuation of Ser. No. 693,257, Apr. 29, 1991, Pat. No. 5,145,391.

[51] Int. Cl.[5] ..... H01R 29/00

[52] U.S. Cl. ..... 439/188; 200/51.1; 439/510; 439/513; 439/490

[58] Field of Search ..... 439/188, 490, 507, 509-515; 200/51.09-51.12

[56] References Cited

U.S. PATENT DOCUMENTS

| | | | |
|---|---|---|---|
| 3,512,043 | 5/1970 | Jaaksoo et al. | 439/188 |
| 4,152,041 | 5/1979 | Hollyday et al. | 439/188 |
| 5,145,391 | 9/1992 | Alwine | 439/188 |

*Primary Examiner*—Paula A. Bradley
*Attorney, Agent, or Firm*—William H. McNeill

[57] ABSTRACT

A connector assembly includes first and second housing having a normally open switch fixed between them. Means are formed on one of the housing for maintaining the switch in an open position. In the event of separation of the housings, spring action causes the arms of the switch to engage electrical contacts, closing a circuit and energizing a warning light. The device has applicability in automatic braking systems for automotive vehicles.

5 Claims, 3 Drawing Sheets

SWITCHING CONNECTOR ASSEMBLY

This is a continuation of copending application Ser. No. 07/693,257, filed on Apr. 29, 1991 now U.S. Pat. No. 5,145,391.

TECHNICAL FIELD

This invention relates to switches and more particularly to a normally open switch incorporated in a connector assembly. Still more particularly, the invention relates to a switch for a connector assembly which is suitable for automotive use.

BACKGROUND ART

Many current automotive connector applications utilize a switching device to warn the driver, as by energizing a warning light, of an inadvertent and/or accidental disengagement of the connector. Such a device, for example, could be employed in the connector assembly for an automatic braking system. These devices currently use relays and transistors and add to the cost and complexity of the system.

DISCLOSURE OF THE INVENTION

It is, therefore, an object of the invention to obviate the disadvantages of the prior art.

It is another object of the invention to enhance connector switches.

Yet another object of the invention is the provision of a simple switch.

Another object of the invention is the provision of an economical switch.

These objects are accomplished, in one aspect of the invention, by the provision of a switch element which comprises an electrically conductive, annular body having oppositely disposed, transversely projecting arms each including a reentrant portion and a terminal portion. The body further includes retention means.

The switch element can be disposed in one part of a connector housing with the terminal portions of the arms in contact with electrical conductors leading to a signalling circuit. Another part of a connector housing mates with the one part and includes means for disengaging the arms from the electrical conductors. The two connector parts, or housings, are suitably fixed together, thus breaking the signalling circuit. In the event that the connector housings separate, the spring action of the arms will cause the arms to engage the electrical conductors, energizing the warning circuit, and alerting the driver.

The extreme simplicity of the switch means and its great economy provide a distinct advance in the art.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
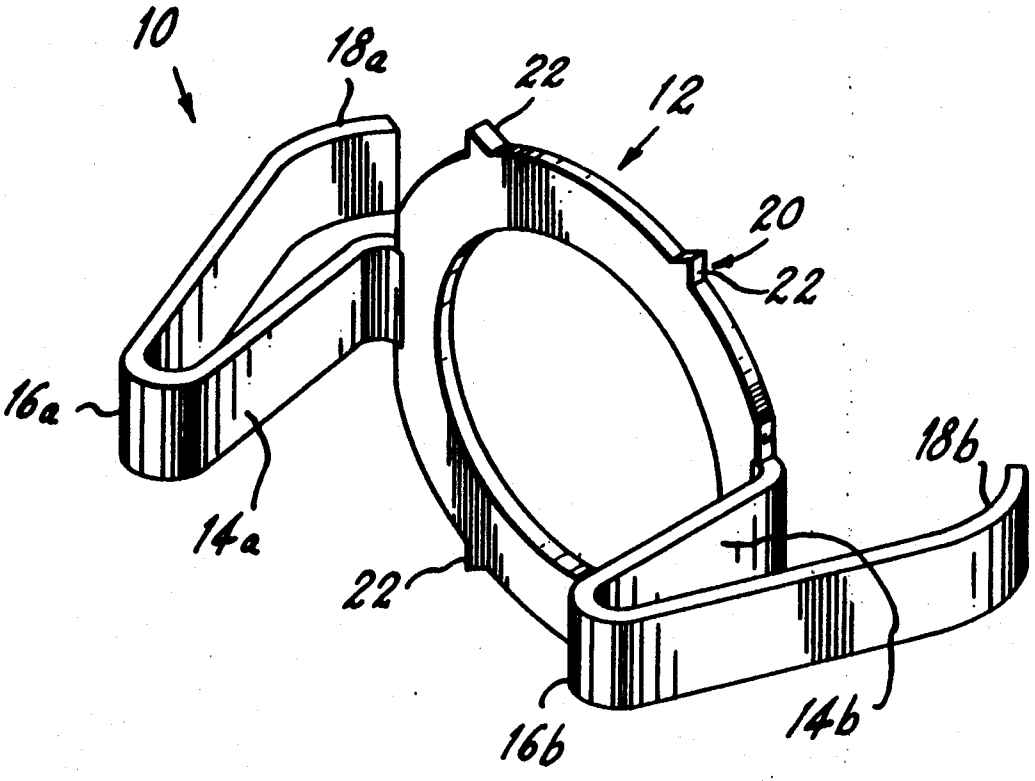
FIG. 1 is a perspective view of a switch element in accordance with an embodiment of the invention.

Referring now to the drawings with greater particularity, there is shown in FIG. 1 a switch element 10 having an electrically conductive, annular body 12 having oppositely disposed, transversely projecting arms 14a and 14b. The arms 14a and 14b include reentrant portions 16a and 16b and terminal portions 18a and *b*. Retention means 20 are formed on the body 12. As illustrated, the retention means 20 comprise substantially triangular projections 22 formed on the periphery 24 of body 12. Other forms of retention means can be employed, depending upon the end use of the switch. The preferred material for the switch body is stainless steel, 0.4 mm thick.

Figure 2:
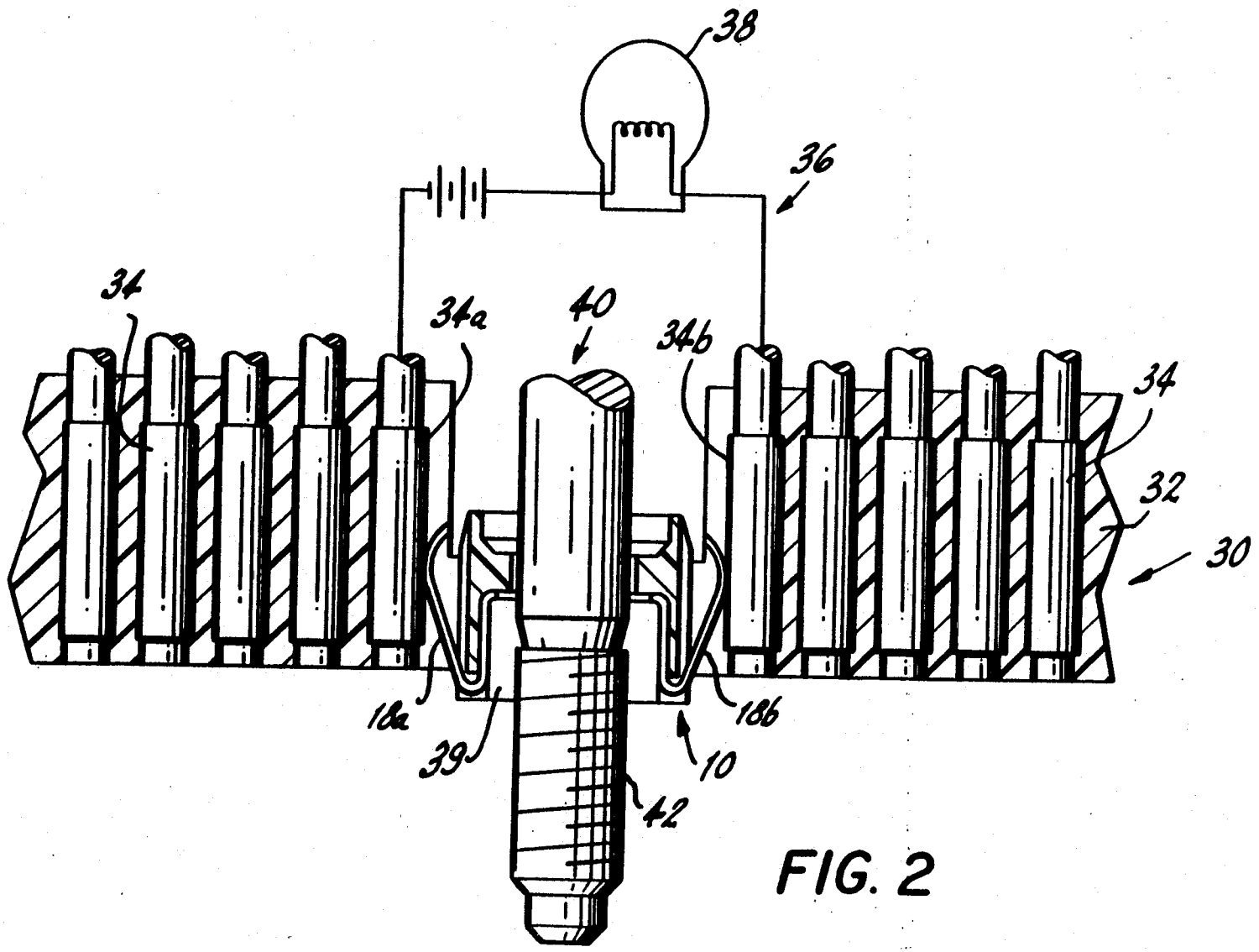
FIG. 2 is an elevational, sectional view of a connector housing including schematic circuit means.

Referring to FIG. 2, there is shown a connector assembly 30 having a first housing 32 containing a plurality of electrical contacts 34. Two of the electrical contacts, for example, 34a and 34b, form a part of a circuit 36 which includes a warning light 38. Switch 10 is fixed in a boss 39 located between electrical contacts 34a and 34b. In the closed and energized position of switch 10, terminal 18a is in engagement with contact 34a and terminal 18b is in engagement with contact 34b. Housing joining means 40, which can be in the form of a fixed, threaded stud 42, is shown extending through an aperture in switch body 12; however, this is exemplary only, and any suitable housing joining means can be employed.

Figure 3:
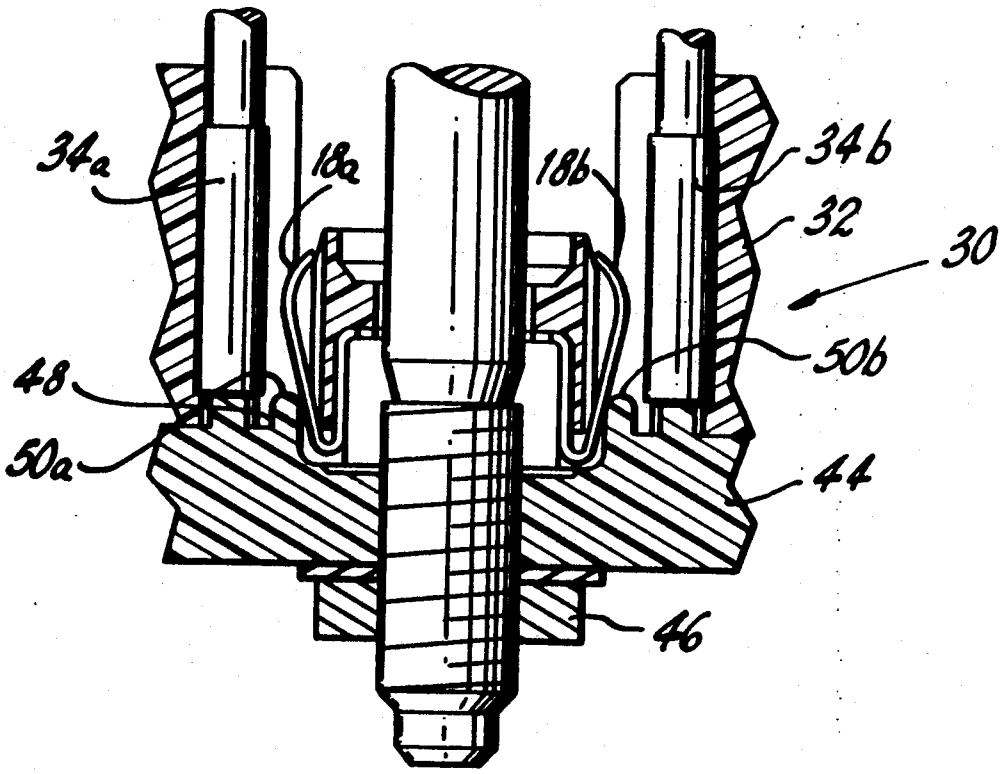
FIG. 3 is a view similar to FIG. 2 with the connectors housings mated.

FIG. 3 illustrates a second housing 44 in fixed engagement with the first housing 32 and held in position by threaded nut 46. The second housing 44 includes switch opening means 48 which can be in the form of projecting limbs 50a and 50b, which engage terminals 18a and 18b, respectively, and maintain the switch 10 in an open position and interrupt power to warning light 38.

Therefore, the latter condition exists so long as the second housing remains mated to the first housing. Should separation occur, terminals 18a and 18b will spring outwardly, engaging electrical contact 34a and 34b and closing circuit 36, thereby energizing warning light 38.

This simple system eliminates the previously employed relays and transistors and greatly reduces the cost.

While there have been shown and described what are at present considered to be the preferred embodiments of the invention, it will be apparent to those skilled in the art that various changes and modifications can be made herein without departing from the scope of the invention as defined by the appended claims.

I claim:

1. In a connector assembly having a first housing containing a plurality of electrical contacts; a second housing for mating with said first housing; holding means for maintaining said housings in a mated condition; and normally open switch means between said housings; the improvement wherein said normally open switch means comprises an annular body having oppositely disposed, transversely projecting arms each including a reentrant portion and a terminal portion; said body further including retention means whereby said body is fixed in one of said first or second housings, said retention means comprising a plurality of projections formed on said body; and switch opening means formed on the other of said housings not containing said body and in engagement with said terminal portions whereby said switch remains open while said housings are mated but closes if said housings become un-mated.

2. The connector assembly of claim 1 wherein said projections are substantially triangular in configuration.

3. In a connector assembly having a first housing containing a plurality of electrical contacts; a second housing for mating with said first housing; holding means for maintaining said housings in a mated condition; and normally open switch means between said housings; the improvement wherein said normally open switch means comprises an annular body surrounding said holding means and having oppositely disposed, transversely projecting arms each including a reentrant portion and a terminal portion; said body further including retention means whereby said body is fixed in one of said first or second housings; and switch opening means formed on the other of said housings not containing said body and in engagement with said terminal portions whereby said switch remains open while said housings are mated but closes if said housings become un-mated.

4. The connector assembly of claim 3 wherein said retention means comprise a plurality of projections formed on said body.

5. The connector assembly of claim 4 wherein said projections are substantially triangular in configuration.

* * * * *